US006389824B2

(12) United States Patent
Ota et al.

(10) Patent No.: US 6,389,824 B2
(45) Date of Patent: May 21, 2002

(54) CONTROLLER FOR VARIABLE DISPLACEMENT COMPRESSOR

(75) Inventors: Masaki Ota; Kazuya Kimura; Masahiro Kawaguchi; Ken Suitou; Ryo Matsubara; Taku Adaniya, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/777,523

(22) Filed: Feb. 6, 2001

(30) Foreign Application Priority Data

Feb. 7, 2000 (JP) ..... 2000-029551

(51) Int. Cl.[7] ..... F04B 1/26; G05D 23/32

(52) U.S. Cl. ..... 62/115; 62/227; 62/417; 62/222.2

(58) Field of Search ..... 417/43, 222.2, 417/115; 62/228.3, 228.5, 227, 158; 236/78 D

(56) References Cited

U.S. PATENT DOCUMENTS 4,905,477 A * 3/1990 Taki ..... 62/228.5
5,189,886 A * 3/1993 Terauchi ..... 236/78 D

FOREIGN PATENT DOCUMENTS

| | | | | |
|---|---|---|---|---|
| JP | 404273949 | * | 9/1992 | ..... 62/228.3 |
| JP | 406180155 | * | 6/1994 | ..... 62/228.3 |
| JP | 6-341378 | | 12/1994 | ..... F04B/49/00 |

* cited by examiner

*Primary Examiner*—William Wayner
(74) *Attorney, Agent, or Firm*—Morgan & Finnegan, LLP

(57) ABSTRACT

A controller controls a displacement of a compressor which is installed in a refrigerant circuit of an air-conditioning system. The controller has a pressure difference detector. An air conditioning switch turns the air conditioning system on. A temperature detector detects the temperature in a compartment. A control valve controls the displacement of the compressor such that the pressure difference detected by the pressure difference detector approaches a target value. A computer determines the target value. The computer changes the target value, depending on the detected temperature. The computer limits the target value to a target value limit. After a predetermined time expires from when the air conditioning switch is turned on, the computer changes the limit. This permits the displacement of the compressor to be promptly and reliably changed.

8 Claims, 10 Drawing Sheets

CONTROLLER FOR VARIABLE DISPLACEMENT COMPRESSOR

BACKGROUND OF THE INVENTION

The present invention relates to a controller for variable displacement compressors to control displacement.

A refrigeration circuit of a typical vehicle air-conditioning system includes a condenser, an expansion valve, which functions as a depressurizing device, an evaporator and a compressor. The compressor draws refrigerant gas from the evaporator and compresses the gas. The compressor then discharges the gas to the condenser. The evaporator transfers heat between the refrigerant in the circuit and air in the passenger compartment. Heat from air that flows about the evaporator is transferred to the refrigerant flowing through the evaporator in accordance with the thermal load or the cooling load. The pressure of the refrigerant gas at the outlet of the evaporator represents the magnitude of the thermal load.

A vehicle variable displacement swash plate type compressor has a displacement control mechanism for setting the pressure (suction pressure Ps) in the vicinity of the outlet of the evaporator to a predetermined target suction pressure. The mechanism adjusts the compressor displacement by changing the inclination angle of the swash plate such that the flow rate of refrigerant corresponds to the cooling load. The displacement control mechanism has a control valve. The control valve includes a pressure sensing member, which is a bellows or a diaphragm. The suction pressure is detected by the Ps pressure sensing member. A valve opening is adjusted in accordance with the displacement of the pressure sensing member, which changes the pressure in a crank chamber, or crank pressure Pc.

A simple control valve that imposes a single target suction pressure cannot control the air conditioning performance accurately. Therefore, an electromagnetic control valve that changes a target suction pressure in accordance with an external current has been proposed. Such a control valve includes an electromagnetic actuator such as a solenoid. The actuator changes a force acting on the pressure sensing member in accordance with an external current to adjust the target suction pressure.

According to the above-described control method, however, even if the target suction pressure is changed by electric control, the actual suction pressure may not reach the target suction pressure spontaneously. That is, the cooling load is likely to affect whether or not the actual suction pressure well responds to a change in the target suction pressure. It is not therefore possible to promptly and reliably alter the displacement of a compressor even if the actual suction pressure is regulated as needed by electric control.

SUMMARY OF THE INVENTION

Accordingly, it is an object of the present invention to provide a control apparatus for a variable displacement type compressor, which can promptly and reliably change the displacement of the compressor.

To achieve the above objective, the present invention provides a controller for controlling the displacement of a compressor. The compressor is included in a refrigeration circuit of an air conditioning system. The controller comprises a pressure difference detector. The pressure difference detector detects the pressure difference between two pressure monitoring points located in the refrigeration circuit. An air conditioning switch turns the air conditioning system on. A temperature detector detects the temperature in a compartment. A mechanism controls the displacement of the compressor such that the pressure difference detected by the pressure difference detector approaches a target value. A computer determines the target value. The computer changes the target value, depending on the detected temperature. The computer limits the target value to a target value limit. After a predetermined time expires from when the air conditioning switch is turned on, the computer changes the limit.

To achieve the above objective, the present invention also provides a method for controlling the displacement of a compressor installed in a refrigerant circuit of an air-conditioning system. The method comprises detecting the pressure difference between two pressure monitoring points located in the refrigerant circuit, detecting the temperature in a compartment, determining a target value of the pressure difference. The determining includes limiting the target value to a target value limit, changing the target value depending on the detected temperature, changing the target value limit after a predetermined time expires from when the air conditioning system is activated, and controlling the displacement of the compressor such that the pressure difference detected by the pressure difference detector approaches the target value.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A vehicle air-conditioning system according to a first embodiment of the present invention will now be described with reference to FIGS. 1 to 14.

Figure 1:
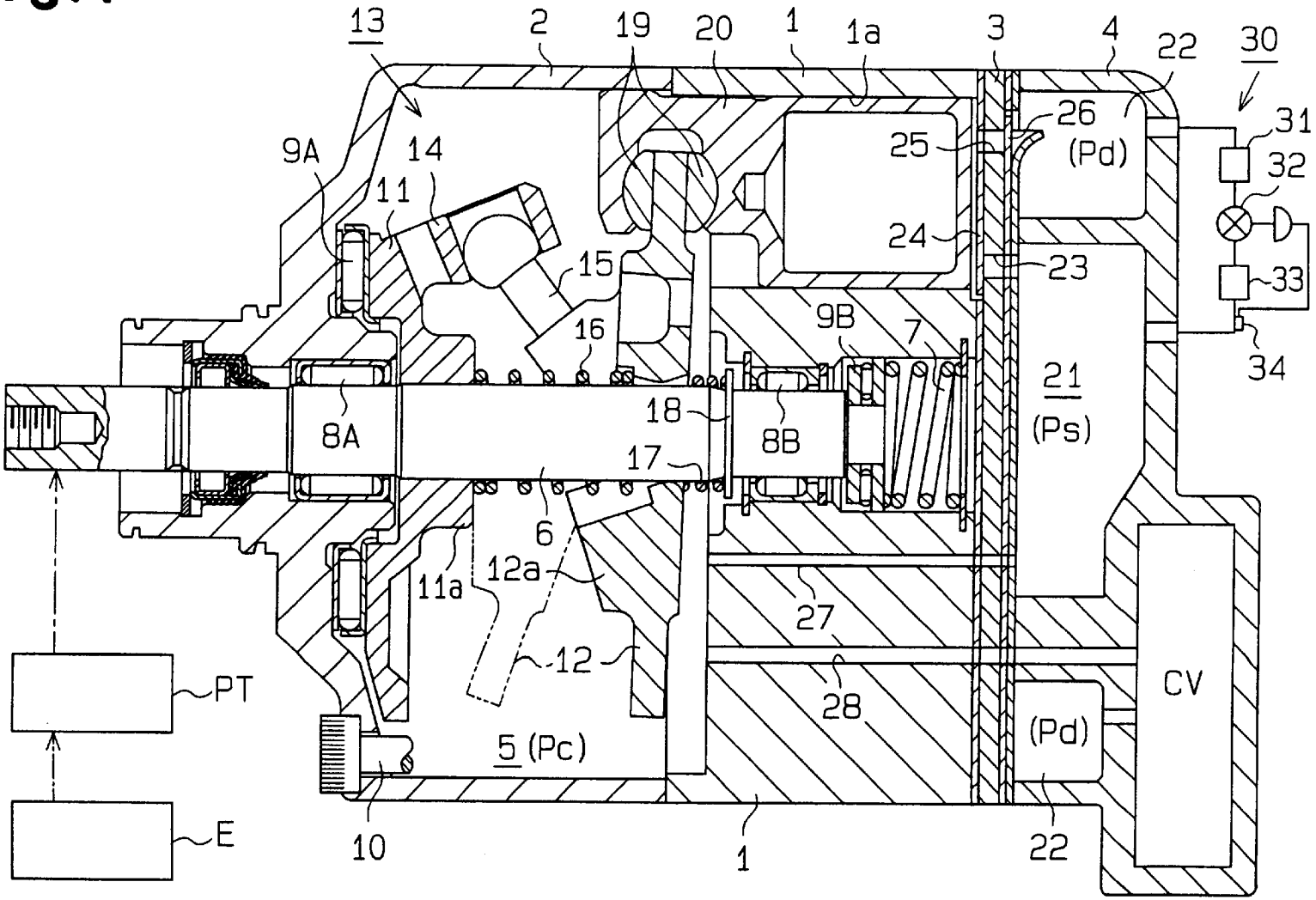
FIG. 1 is a cross-sectional diagram of a variable displacement type swash plate compressor according to one embodiment of the present invention.

The compressor shown in FIG. 1 is a swash plate type variable displacement reciprocal compressor. The compressor includes a cylinder block 1, a front housing member 2, which is secured to the front end face of the cylinder block 1, and a rear housing member 4, which is secured to the rear end face of the cylinder block 1. A valve plate 3 is located between the cylinder block 1 and the rear housing member 4. The cylinder block 1, the front housing member 2, the valve plate 3 and the rear housing member 4 are secured to one another by bolts 10 (only one is shown) to form the compressor housing.

A crank chamber 5 is defined between the cylinder block 1 and the front housing member 2. A drive shaft 6 extends through the crank chamber 5 and is rotatably supported through radial bearings 8A, 8B by the housing. A recess is formed in the center of the cylinder block 1. A spring 7 and a rear thrust bearing 9B are located in the recess. A lug plate 11 is secured to the drive shaft 6 in the crank chamber 5 to rotate integrally with the drive shaft 6. A front thrust bearing 9A is located between the lug plate 11 and the inner wall of the front housing member 2. A rear thrust bearing 9B is located adjacent to the rear end of the drive shaft 6. The drive shaft 6 is supported in the axial direction by the rear bearing 9B, which is urged in a forward direction by the spring 7, and the front bearing 9A.

The front end of the drive shaft 6 is connected to an external drive source, which is an engine E in this embodiment, through a power transmission mechanism PT. In this embodiment, the power transmission mechanism PT is a clutchless mechanism that includes, for example, a belt and a pulley. Alternatively, the mechanism PT may be a clutch mechanism (for example, an electromagnetic clutch) that selectively transmits power in accordance with the value of an externally supplied current.

A drive plate, which is a swash plate 12 in this embodiment, is accommodated in the crank chamber 5. The swash plate 12 has a hole formed in the center. The drive shaft 6 extends through the hole in the swash plate 12. The swash plate 12 is coupled to the lug plate 11 by a guide mechanism, which is a hinge mechanism 13 in this embodiment. The hinge mechanism 13 includes two support arms 14 (only one is shown) and two guide pins 15 (only one is shown). Each support arm 14 projects from the rear side of the lug plate 11. Each guide pin 15 projects from the swash plate 12. The swash plate 12 rotates integrally with the lug plate 11 and drive shaft 6. The swash plate 12 slides along the drive shaft 6 and tilts with respect to the axis of the drive shaft 6. The swash plate 12 has a counterweight 12*a* located at the opposite side of drive shaft 6 with respect to the drive hinge mechanism 13.

A first spring 16 is located between the lug plate 11 and the swash plate 12 to reduce the angle of the swash plate 12. The first spring 16 urges the swash plate 12 toward the cylinder block 1, or in the direction decreasing the inclination of the swash plate 12. The inclination of the swash plate 12 is defined by an inclination angle, which is the angle between the swash plate 12 and a plane perpendicular to the drive shaft 6. A stopper ring 18 is fixed on the drive shaft 6 behind the swash plate 12. A second spring 17 is fitted about the drive shaft 6 between the stopper ring 18 and the swash plate 12. When the inclination angle is great as shown by broken line in FIG. 1, the second spring 17 does not apply force to the swash plate 12 and other members. When the inclination angle is small, as shown by solid lines in FIG. 1, the second spring 17 is compressed between the stopper ring 18 and the swash plate 12 and urges the swash plate 12 away from the cylinder block 1, or in a direction increasing the inclination angle. The normal length of the second spring 17 and the location of the stopper ring 18 are determined such that the second spring 17 is not fully contracted when the swash plate 12 is inclined by the minimum inclination angle (for example, an angle from one to five degrees).

Cylinder bores 1*a* (only one shown) are formed in the cylinder block 1. The cylinder bores 1*a* are arranged at equal angular intervals about the drive shaft 6. The rear end of each cylinder bore 1*a* is blocked by the valve plate 3. A single headed piston 20 is reciprocally accommodated in each cylinder bore 1*a*. Each piston 20 and the corresponding cylinder bore 1*a* define a compression chamber, the volume of which is changed according to reciprocation of the piston 20. The front portion of each piston 20 is coupled to the swash plate 12 by a pair of shoes 19. Therefore, rotation of the swash plate 12 reciprocates each piston 20 by a stroke that corresponds to the angle of the swash plate 12.

A suction chamber 21 and a discharge chamber 22 are defined between the valve plate 3 and the rear housing member 4. The discharge chamber 22 surrounds the suction chamber 21. The valve plate 3 has suction ports 23 and discharge ports 25, which correspond to each cylinder bore 1*a*. The valve plate 3 also has suction valve flaps 24, each of which corresponds to one of the suction ports 23, and discharge valve flaps 26, each of which corresponds to one of the discharge ports 25. The suction ports 23 connect the suction chamber 21 with the cylinder bores 1*a*. The discharge ports 25 connect the cylinder bores 1*a* with the discharge chamber 22.

When each piston 20 moves from the top dead center position to the bottom dead center position, refrigerant gas in the suction chamber 21, which is a suction pressure zone, flows into the corresponding cylinder bore 1*a* via the corresponding suction port 23 and suction valve 24. When each piston 20 moves from the bottom dead center position to the top dead center position, refrigerant gas in the corresponding cylinder bore 1*a* is compressed to a predetermined pressure and is discharged to the discharge chamber 22, which is a discharge pressure zone, via the corresponding discharge port 25 and discharge valve 26.

Power of the engine E is transmitted to and rotates the drive shaft 6. Accordingly, the swash plate 12, which is inclined by an angle, is rotated. Rotation of the swash plate 12 reciprocates each piston 20 by a stroke that corresponds to the angle. As a result, suction, compression and discharge of refrigerant gas are repeated in the cylinder bores 1*a*.

The inclination angle of the swash plate 12 is determined according to various moments acting on the swash plate 12. The moments include a rotational moment, which is based on the centrifugal force of the rotating swash plate 12, a spring force moment, which is based on the force of the springs 16 and 17, a moment of inertia of the piston reciprocation, and a gas pressure moment. The gas pressure moment is generated by the force of the pressure in the cylinder bores 1*a* and the pressure in the crank chamber 5 (crank pressure Pc). The gas pressure moment is adjusted by changing the crank pressure Pc by a displacement control valve CV, which will be discussed below. Accordingly, the inclination angle of the plate 12 is adjusted to an angle between the maximum inclination and the minimum inclination. The contact between the counterweight 12*a* and a stopper 11*a* of the lug plate 11 prevents further inclination of the swash plate 12 from the maximum inclination. The minimum inclination is determined based chiefly on the forces of the springs 16 and 17 when the gas pressure moment is maximized in the direction by which the swash plate inclination is decreased.

Figure 2:
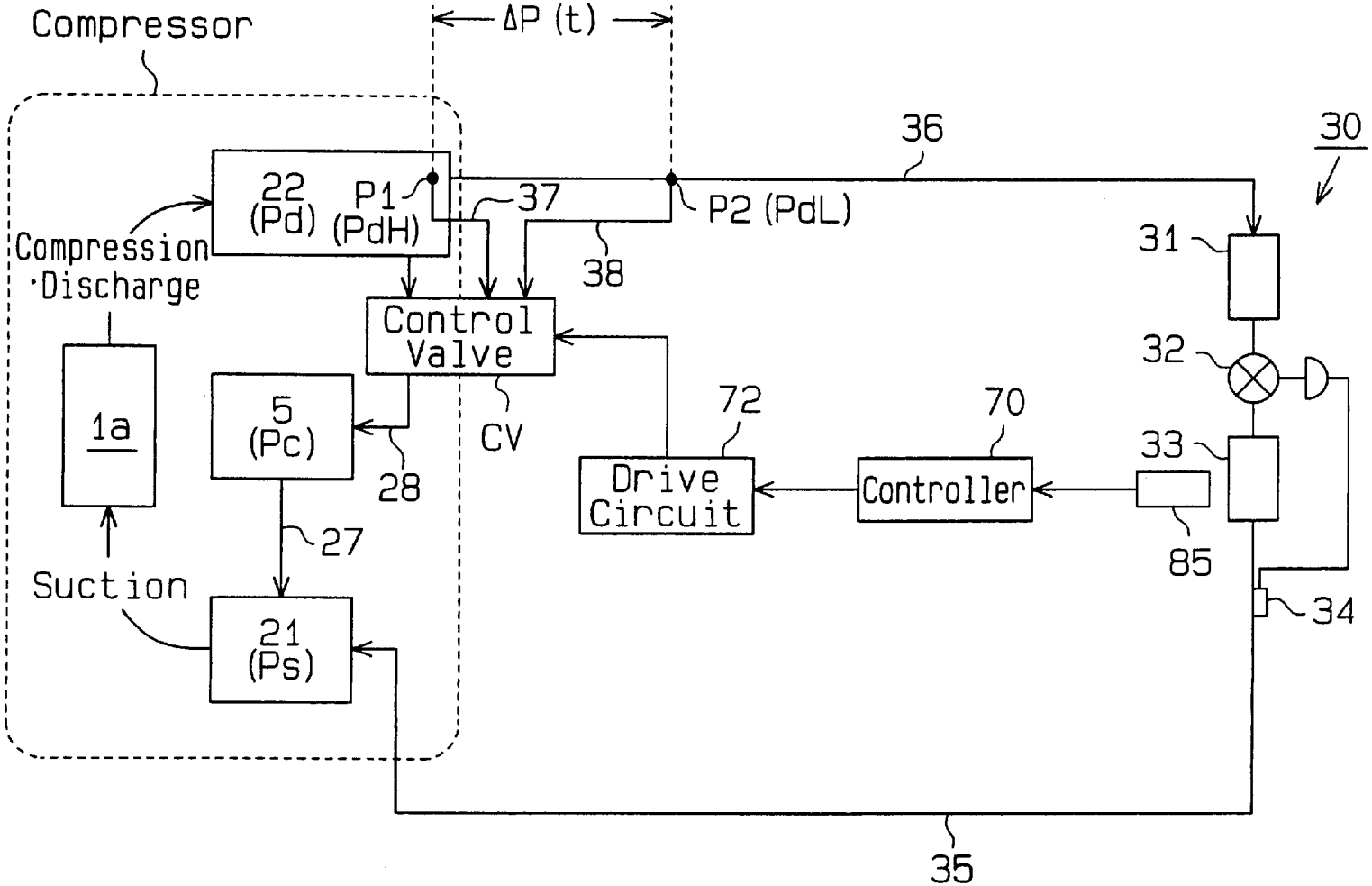
FIG. 2 is a circuit diagram illustrating the outline of a cooling circuit according to the embodiment.

A mechanism for controlling the crank pressure Pc includes a bleeding passage 27, a supply passage 28 and the control valve CV as shown in FIGS. 1 and 2. The passages 27, 28 are formed in the housing. The bleeding passage 27 connects the suction chamber 21 with the crank chamber 5. The supply passage 28 connects the discharge chamber 22 with the crank chamber 5. The control valve CV is located in the supply passage 28.

The control valve CV changes the opening of the supply passage 28 to adjust the flow rate of refrigerant gas from the discharge chamber 22 to the crank chamber 5. The crank pressure Pc is changed in accordance with the relationship between the flow rate of refrigerant gas from the discharge chamber 22 to the crank chamber 5 and the flow rate of refrigerant gas flowing out from the crank chamber 5 to the suction chamber 21 through the bleeding passage 27. The difference between the crank pressure Pc and the pressure in the cylinder bores 1*a* is changed in accordance with the crank pressure Pc, which varies the inclination angle of the swash plate 12. This alters the stroke of each piston 20 and the compressor displacement.

FIG. 1 illustrates a refrigeration circuit of a vehicle air-conditioning system. The refrigeration circuit has a compressor and an external refrigeration circuit 30. The refrigeration circuit 30 includes, for example, a condenser 31, an expansion valve 32 and an evaporator 33. The opening of the expansion valve 32 is feedback-controlled based on the temperature detected by a heat sensitive tube 34 at the outlet of the evaporator 33. The expansion valve 32 supplies refrigerant, the amount of which corresponds to the thermal load on the evaporator 33, to regulate the flow rate. A passage 35 is provided in a downstream portion of the external refrigerant circuit 30 for connecting the outlet of the evaporator 33 to the suction chamber 21 of the compressor. A passage 36 is provided in an upstream portion of the external refrigerant circuit 30 for connecting the discharge chamber 22 of the compressor to the inlet of the condenser 31. The compressor draws refrigerant gas from the downstream portion of the refrigeration circuit 30 and compresses the gas. The compressor then discharges the compressed gas to the upstream portion of the circuit 30.

The greater the displacement of the compressor is, the higher the flow rate of refrigerant in the refrigeration circuit is. The greater the flow rate of the refrigerant, the greater the pressure loss per unit length in the circuit is. That is, the pressure loss between two points in the refrigeration circuit corresponds to the flow rate of refrigerant in the circuit. By detecting the pressure difference $\Delta P(t)$ ($\Delta P(t)=PsH-PsL$) between two points P1, P2, the displacement of the compressor is detected indirectly. In this embodiment, the point P1 is located in the discharge chamber 22 and is an upstream pressure monitoring point. The point P2 is located in the passage 36 at a position spaced from the point 1 by a predetermined distance and is a downstream pressure monitoring point. The gas pressure PdH at the point P1 is applied to the displacement control valve CV through a first pressure detecting passage 37. The gas pressure PdL at the point P2 is applied to the displacement control valve CV through a second pressure detecting passage 38. The displacement control valve CV performs a feedback control procedure for the compressor displacement in accordance with the pressure difference between the point P1 and the point P2 (PdH−PdL).

Figure 3:
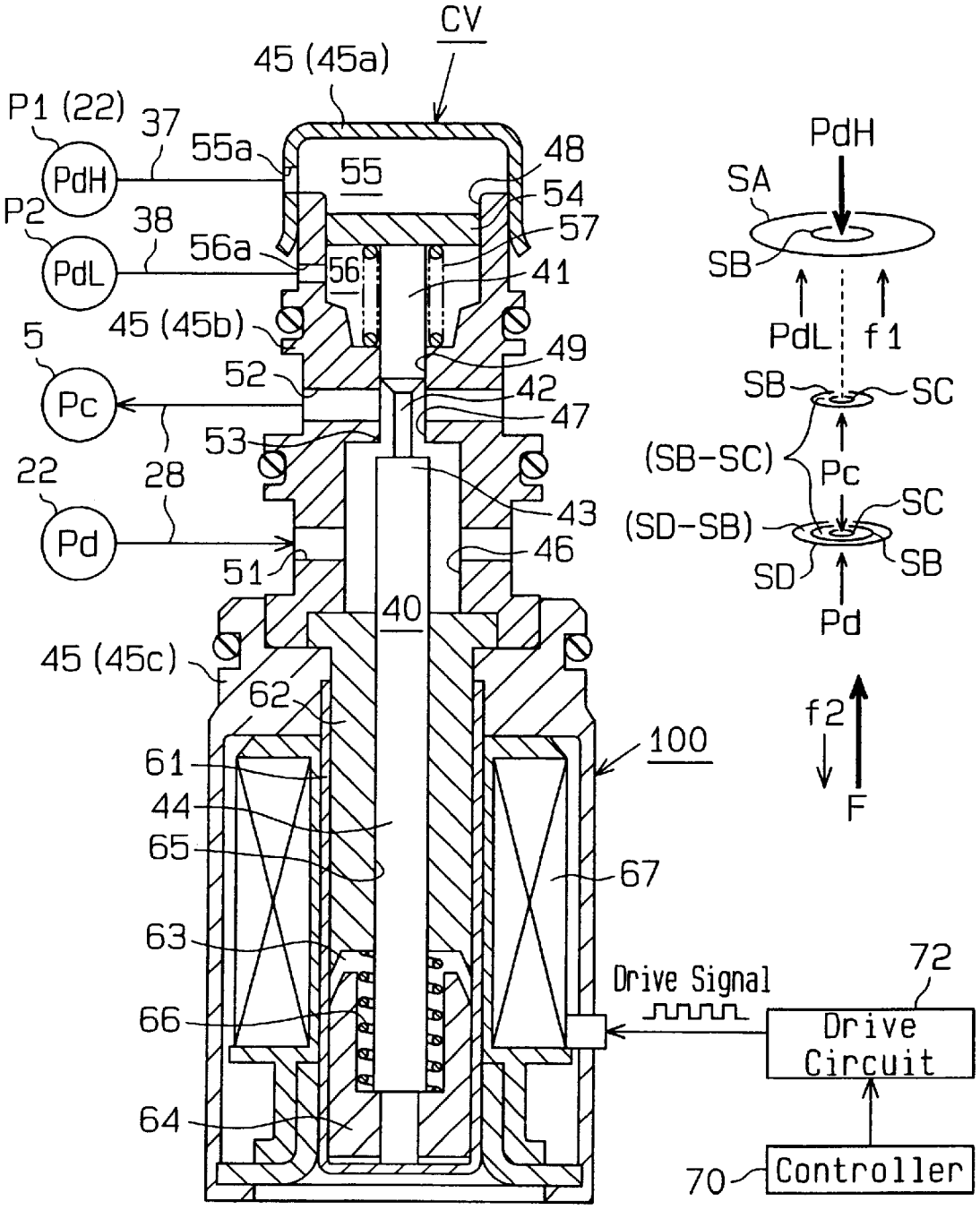
FIG. 3 is a cross-sectional diagram of a control valve provided in the compressor in FIG. 1.

A displacement control valve CV shown in FIG. 3 mechanically detects a differential pressure $\Delta P(t)$ between two points in a cooling circuit, and directly uses the differential pressure to adjust its opening degree.

The control valve CV includes an inlet valve portion and a solenoid. The inlet valve portion adjusts the opening size of the supply passage 28 connecting the discharge chamber 22 to the crank chamber 5. The solenoid functions as an electromagnetic actuator 100 that controls a rod 40 provided in the control valve CV in accordance with an external electric current supply. A pressure difference receiving portion 41 is provided at a distal end of the rod 40. A valve body 43 is provided at a substantially intermediate portion of the rod 40. The pressure difference receiving portion 41 is connected to the valve body 43 by a connecting portion 42. The rod 40 further includes a guide portion 44. The valve body 43 forms part of the guide portion 44. The diameter d1 of the pressure difference receiving portion 41, the diameter d2 of the connecting portion 42, and the diameter d3 of the guide portion 44 (the valve body 43) satisfy the following condition: $d2<d1<d3$. The cross-sectional area SB of the pressure difference receiving portion 41 in a plane perpendicular to the axis of the rod 40 is $\pi(d1/2)^2$. The cross-sectional area SC of the connecting portion 42 in a plane perpendicular to the axis of the rod 40 is $\pi(d2/2)^2$. The cross-sectional area SD of the guide portion 44 (the valve body 43) in a plane perpendicular to the axis of the rod 40 is $\pi(d3/2)^2$.

The control valve CV has a valve housing 45 including a cap 45*a*, an upper body section 45*b*, and a lower body section 45*c*, as shown in FIG. 3. A valve chamber 46 and a communication passage 47 are formed in the upper body section 45*b*. A pressure sensing chamber 48 is provided between the upper body section 45*b* and the cap 45*a*.

The rod 40 extends through the valve chamber 46, the communication passage 47, and the pressure sensing chamber 48 and moves along the axis of the control valve CV. The valve chamber 46 is selectively connected to and disconnected from the passage 47 in accordance with the position of the rod 40. The communication passage 47 is completely blocked from the pressure sensing chamber 48 by a wall that formes part of the valve housing 45. The diameter of the passage 47 and the diameter of a guide hole 49 are equal to the diameter d1 of the pressure difference receiving portion 41 of the rod 40.

The bottom of the valve chamber 46 is formed by the upper surface of a fixed iron core 62. An inlet port 51 extends radially from the valve chamber 46. The valve chamber 46 is connected to the discharge chamber 22 through the inlet port 51 and the upstream portion of the supply passage 28. An outlet port 52 radially extends from the communication passage 47. The communication passage 47 is connected to the crank chamber 5 through the downstream portion of the supply passage 28 and the outlet port 52. Therefore, the inlet port 51, the valve chamber 46, the communication passage 47 and the outlet port 52, which are formed in the control valve CV, form a part of the supply passage 28, which connects the discharge chamber 22 with the crank chamber 5.

The valve body 43 of the rod 40 is located in the valve chamber 46. The diameter d1 of the communication passage 47 is larger than the diameter d2 of the connecting portion 42 of the rod 40 and is smaller than the diameter d3 of the large diameter the end portion 44. A valve seat 53 is formed about the opening of the communication passage 47, which functions as a valve hole. If the rod 40 is moved from the position shown in FIG. 3, or its lowest position, to its highest position, where the valve body 43 contacts the valve seat 53, the communication passage 47 is closed. That is, the valve body 43 of the rod 40 functions as an inlet valve body, which controls the opening size of the supply passage 28. In this description, upward is the direction in which the rod 40 closes the communication passage 47, and downward is the direction in which the rod 40 opens the passage 47.

An axially movable wall 54, or partition member, is provided in the pressure sensing chamber 48. The movable wall 54 axially divides the pressure sensing chamber 48 into two sections, or a first pressure chamber 55 and a second pressure chamber 56. The movable wall 54 separates the first pressure chamber 55 from the second pressure chamber 56. The first pressure chamber 55 is thus isolated from the second pressure chamber 56. The cross-sectional area SA of the movable wall 54 in a plane perpendicular to the axis of the rod 40 is greater than the cross-sectional area SB of the passage 47 or the guide hole 49 (SB<SA) perpendicular to the axis of the rod 40.

The first pressure chamber 55 is constantly connected to the discharge chamber 22, in which the point P1 is located, through a P1 port 55*a* formed in the cap 45*a* and the first pressure detecting passage 37. The second pressure chamber 56 is constantly connected to the point P2 through a P2 port 56*a*, which extends through the upper body section 45*b*, and the second pressure detecting passage 38. Accordingly, the discharge pressure Pd is applied to the first pressure chamber 55 as the pressure PdH, and the pressure PdL at the point P2 located in the passage 36 is applied to the second pressure chamber 56. That is, the upper side of the movable wall 54 is exposed to the pressure PdH, and the lower side of the movable wall 54 is exposed to the pressure PdL, as viewed in FIG. 3. A distal end, or upper end, of the pressure difference receiving portion 41 of the rod 40 is located in the second pressure chamber 56. The movable wall 54 is secured to the distal end of the pressure difference receiving portion 41. A dampener spring 57 is provided in the second pressure chamber 56 for urging the movable wall 54 toward the first pressure chamber 55.

The solenoid 100, or the electromagnetic actuator 100, which controls the rod 40 in accordance with an external electric current supply, has an accommodating cylinder 61 with a closed end. The fixed iron core 62 is fitted in an upper section of the cylinder 61, and a solenoid chamber 63 is formed in the cylinder 61. The solenoid chamber 63 accommodates a movable iron core 64, or plunger. The movable core 64 axially moves in the solenoid chamber 63.

A guide hole 65 extends axially through the middle of the fixed core 62. The guide hole 65 accommodates the guide portion 44 of the rod 40. The guide portion 44 axially moves in the guide hole 65. A clearance (not shown) is defined between the wall of the guide hole 65 and the guide portion 44. The clearance connects the valve chamber 46 to the solenoid chamber 63. The solenoid chamber 63 thus receives the discharge pressure Pd, like the valve chamber 46.

A lower end of the guide portion 44, or the proximal end of the rod 40, is fitted in a hole formed in the middle of the movable core 64 and is fixed to the movable core 64. The movable core 64 thus moves integrally with the rod 40. A return spring 66 is provided between the fixed core 62 and the movable core 64. The return spring 66 urges the movable core 64 in a direction to separate the movable core 64 from the fixed core 62, or downward. That is, the return spring 66 functions as an initializing means that returns the movable core 64 and the rod 40 to their lowermost positions.

A coil 67 is wound around the fixed core 62 and the movable core 64. A drive circuit 72 sends a drive signal indicating a predetermined duty ratio Dt to the coil 67, in accordance with an instruction of a controller 70. The coil 67 then generates electromagnetic force F that corresponds to the duty ratio Dt or in accordance with an external electric current supply to the coil 67. The electromagnetic force F attracts the movable core 64 toward the fixed core 62, thus moving the rod 40 upward. The electric current supply to the coil 67 may be controlled by an analog electric current control procedure, a duty control procedure, in which the duty ratio Dt is altered as necessary, or a pulse width modulation control procedure (PWM control procedure). As the duty ratio Dt becomes smaller, the opening size of the control valve CV becomes larger. That is, as the duty ratio Dt becomes larger, the opening size of the control valve CV becomes smaller.

The opening size of the control valve CV of FIG. 3 is determined in accordance with the position of the rod 40 including the valve body 43. The operational conditions and characteristics of the control valve CV are determined in relation to the forces acting on various portions of the rod 40.

An upper side of the pressure difference receiving portion 41 of the rod 40 receives a downward force that is generated in accordance with the equilibrium of the pressure difference between the first pressure chamber 55 and the second pressure chamber 56 (PdH−PdL) and the upward force f1 of the dampener spring 57. The pressure receiving area of the upper side of the movable wall 54 is SA, and the pressure receiving area of the lower side of the movable wall 54 is SA−SB. Further, an upward force that is generated by the crank pressure Pc is applied to the lower side of the pressure difference receiving portion 41, the pressure receiving area of which is SB−SC. If the downward direction is considered to be the positive direction, a total force ΣF1 applied to the pressure difference receiving portion 41 is represented by the following equation (1):

$$\Sigma F1 = PdH \cdot SA - PdL(SA - SB) - f1 - Pc(SB - SC) \quad (1)$$

The guide portion 44 of the rod 40 receives an upward force that is generated in accordance with the equilibrium between the electromagnetic force F of the coil 67 and the downward force f2 of the return spring 66.

Figure 4:
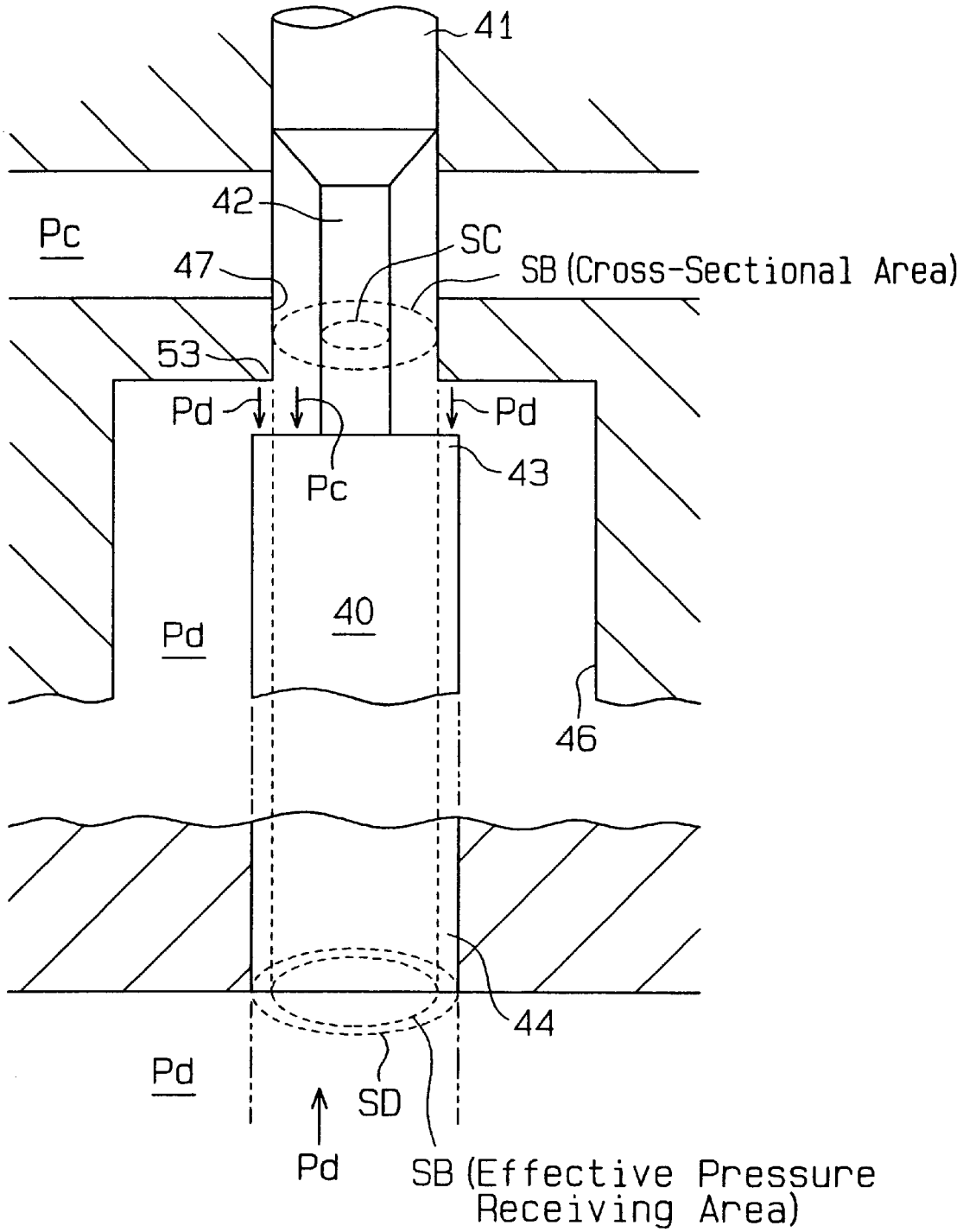
FIG. 4 is a partly enlarged cross-sectional diagram for explaining the positioning of an actuation rod.
Figure 13:
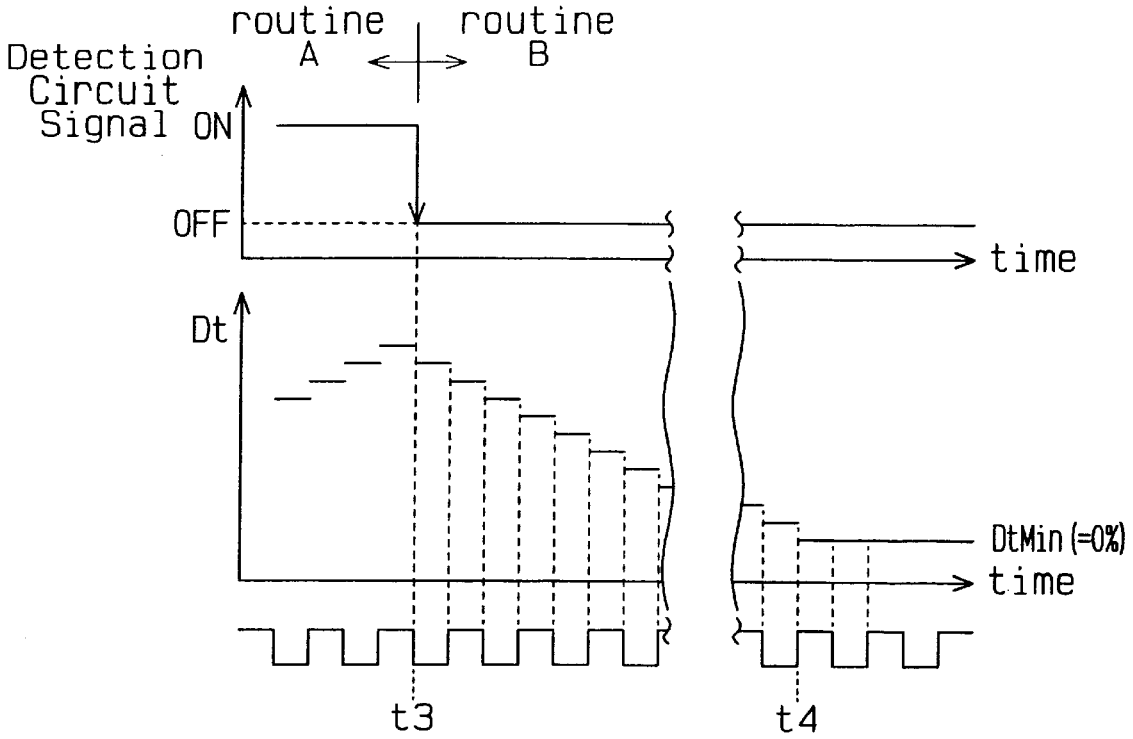
FIG. 13 is a time chart showing the correlation between the duty ratio and the detection circuit signal.

The pressures acting on the valve body 43, the guide portion 44, and the movable core 64 will now be explained with reference to FIG. 13. The upper side of the valve body 43 is divided into two sections, an inner section and an outer section, with respect to a hypothetical cylindrical surface extending around the axis of the rod 40 and along the wall of the communication passage 47 (as indicated by broken lines in FIG. 13). As shown in FIG. 4, the crank pressure Pc applies an axially downward force over a cross-sectional area SB−SC of the inner section, and the discharge pressure Pd applies an axially downward force over a cross-sectional area SD−SB of the outer section. Further, the discharge pressure Pd applies an upward axial force to a lower side of the guide portion 44 over a cross-sectional area SD in a plane perpendicular to the axis of the guide portion 44. If the upward direction is considered to be the positive direction, the total force ΣF applied to the valve body 43 and the guide portion 44 is indicated by the following equation (2):

$$\begin{aligned} \sum F2 &= F - f2 - Pc(SB - SC) - Pd(SD - SB) + Pd \cdot SD \\ &= F - f2 - Pc(SB - SC) + Pd \cdot SB \end{aligned} \quad (2)$$

If it is assumed that the discharge pressure Pd is applied only to the lower side of the guide portion 44 of the rod 40, equation (2) indicates that the effective pressure receiving area of the rod 40 is represented by the following equation: SD−(SD−SB)=SB. That is, the effective pressure receiving area of the guide portion 44, which receives the discharge pressure Pd, corresponds to the cross-sectional area SB of the passage 47, regardless of the cross-sectional area SD of the guide portion 44. When opposite ends of a rod or the like receive the same type of pressure, the difference between the opposed surfaces areas that receive the pressure is defined as the effective pressure receiving area.

Equation (2) is satisfied even if the cross-sectional area of the valve body 43 and that of the guide portion 44 is SB and the valve body 43 is inserted in the passage 47 (the cross-sectional area of which is SB), and if the crank pressure Pc acts on the upper side of the valve body 43 and the discharge pressure Pd is applied to the lower side of the guide portion 44.

The rod 40 is formed by the pressure difference receiving portion 41 and the guide portion 44 that are connected by the connecting portion 42. The rod 40 is thus positioned to satisfy the following condition: $\Sigma F1=\Sigma F2$. Based on equations (1), (2), the following equation (3) is obtained:

$$(PdH-PdL)SA-Pd\cdot SB+PdL\cdot SB=F-f2+f1 \quad (3)$$

In this embodiment, the point P1 is located in the discharge chamber 22. Accordingly, the following equation is satisfied: Pd=PdH. If this equation is applied to equation (3), equations (4), (5) are obtained.

$$(PdH-PdL)SA-(PdH-PdL)SB=F-f2+f1 \quad (4)$$

$$PdH-PdL=(F-f2+f1)/(SA-SB) \quad (5)$$

In equation (5), only the electromagnetic force F is varied in accordance with an electric current supplied to the coil 67. The opening size of the displacement control valve CV shown in FIG. 3 is adjusted by performing an external duty control procedure for the coil 67 to alter a target value for the pressure difference between P1 and P2, or $\Delta P(t)=PdH-PdL$ (which is a target pressure difference TPD). In other words, the control valve CV is externally controlled to alter the target pressure difference TPD. A target pressure difference determining means of the control valve CV shown in FIG. 3 is formed by the electronic actuator 100, the return spring 66, and the dampener spring 57.

Equation (5) does not have pressure parameters (values including Pc or Pd) other than the pressure difference between P1 and P2 (PdH−PdL) This indicates that the rod 40 is positioned regardless of the crank pressure Pc and the discharge pressure Pd. In other words, the rod 40 is positioned regardless of pressure parameters other than the pressure difference between P1 and P2. The control valve CV of FIG. 3 is thus smoothly operated only in relation to the equilibrium of the force caused by the pressure difference between P1 and P2 $\Delta P(t)$, the electromagnetic force F, and the urging forces f1, f2.

The operational characteristics of the displacement control valve of the first embodiment will hereafter be described. When the current supply to the coil 67 is null (Dt=0%), the return spring 66 maintains the rod 40 at its lowermost position, as shown in FIG. 3. In this state, the valve body 43 of the rod 40 is spaced from the valve seat 53 by a maximum distance. The inlet valve portion of the control valve CV is thus completely opened. If an electric current with a minimum duty ratio Dt is supplied to the coil 67, the upward electromagnetic force F becomes greater than the downward force f2 of the spring 66. The upward force (F−f2) matches a downward force determined by the equilibrium between the pressure difference between P1 and P2 (PdH−PdL) and the force f1 of the dampener spring 57. Accordingly, the valve body 43 is positioned with respect to the valve seat 53 to satisfy the equation (5), thus determining the opening size of the control valve CV. This determines the amount of gas flowing to the crank chamber 5 through the supply passage 28. The opening size of the CV does not regulate the passage 27. The crank pressure Pc is thus adjusted.

As long as the electromagnetic force F is constant, the control valve CV of FIG. 3 is operated with a target pressure difference TPD corresponding to the current electromagnetic force F. If the electromagnetic force F is altered in accordance with an external electric current supply, the control valve CV changes the target pressure difference TPD accordingly.

Figure 5:
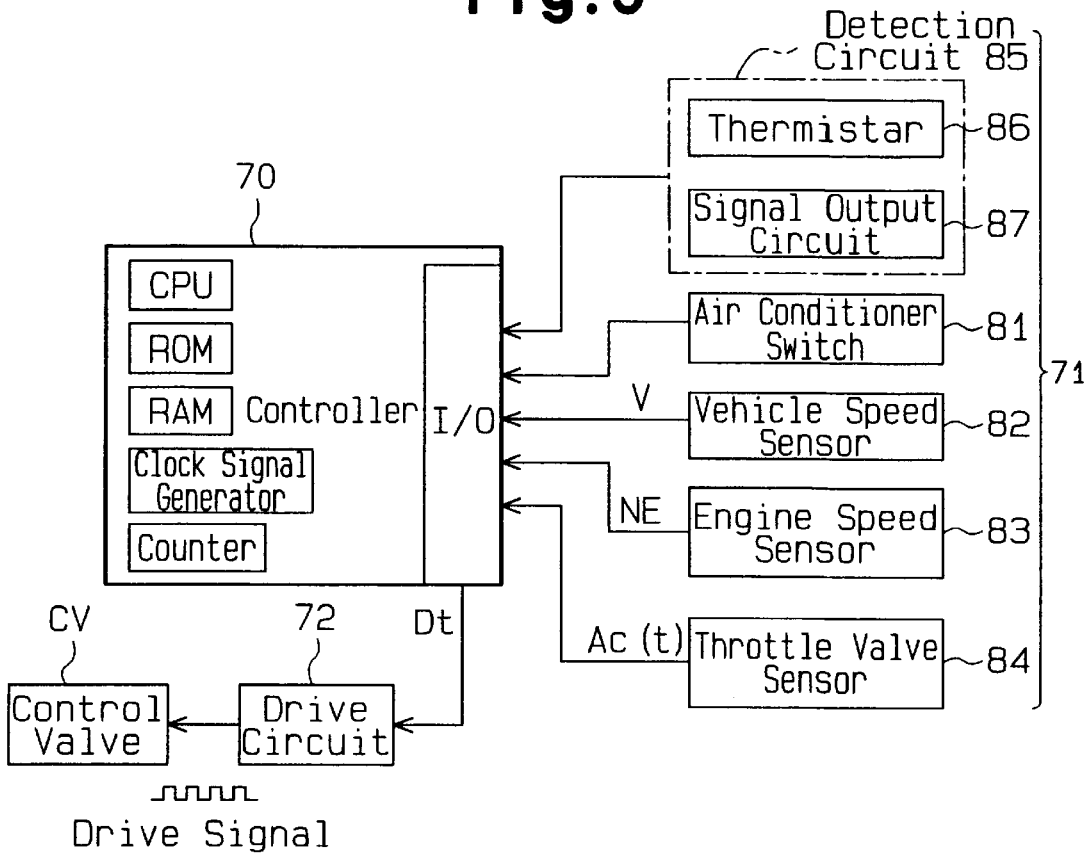
FIG. 5 is a block diagram showing the electric structure of a control apparatus for the compressor in FIG. 1.

As shown in FIGS. 2, 3 and 5, an air-conditioner for a vehicle comprises a controller 70. The controller 70 that is connected to the control valve CV via a drive circuit 72. As shown in FIG. 5, the controller 70 is a control unit comprising a CPU, a ROM, a RAM, a clock signal generator, a counter and an input/output (I/O) interface circuit.

Various control programs (see flowcharts in FIGS. 7 to 11) and initial data, which will be discussed later, are stored in the ROM. The RAM provides a work memory area. The clock signal generator generates a clock pulse signal at a predetermined interval. The clock signal is used as a regular interruption signal to inform the CPU of the timing of initiating a regular interruption routine. The counter counts the pulses of the clock signal generated by the clock signal generator.

The I/O interface circuit of the controller 70 is provided with a plurality of input and output terminals. An external information detector 71 is connected to the input terminals of the I/O interface circuit, and the drive circuit 72 is connected to the output terminals of the I/O interface circuit.

The controller 70 computes a proper duty ratio Dt based on various external information provided from the external information detector 71 and sends a signal representing the duty ratio Dt to the drive circuit 72. The drive circuit 72 sends a drive signal having the duty ratio Dt to a coil 67 of the control valve CV. The electromagnetic force F of the solenoid section changes in accordance with the duty ratio Dt of the drive signal supplied to the coil 67. This ensures arbitrary real-time adjustment of the degree of opening of the control valve CV to promptly change the crank pressure Pc and the piston stroke. In other words, the displacement of the compressor is swiftly altered.

Sensors that constitute the external information detector 71 include an air conditioner switch (hereinafter referred to as "A/C switch") 81, a vehicle speed sensor 82, an engine speed sensor 83, a gas pedal sensor 84 which detects the angle or the degree of opening of the throttle valve, and a detection circuit 85. The A/C switch 81 switches ON or OFF the air conditioner and is manipulated by a passenger in a vehicle. The A/C switch 81 provides the controller 70 with information about the ON/OFF setting of the air conditioner. The vehicle speed sensor 82 and engine speed sensor 83 provide the controller 70 with information about a vehicle speed V and engine speed NE. The gas pedal sensor 84 detects the angle (or the degree of opening) of the throttle valve in the intake passage of the engine E. The throttle valve angle (the degree of throttle opening) reflects the amount of depression of the acceleration pedal by the driver of the vehicle (i.e., an acceleration position Ac(t)).

The detection circuit 85, which serves as temperature detector, is provided near an evaporator 33 (see FIG. 2). The detection circuit 85 provides the controller 70 with information about the temperature near the evaporator 33. The temperature near the evaporator 33 is correlated with the surface temperature of the evaporator 33 and the passenger compartment temperature that is the target in the air-conditioning control. The detection circuit 85 has a thermistor 86 as a temperature sensor to detect the temperature near the evaporator 33 and a signal output circuit 87. The signal output circuit 87 outputs a detection circuit signal based on a change in the resistance of the thermistor 86, corresponds to a change in the temperature.

Figure 6:
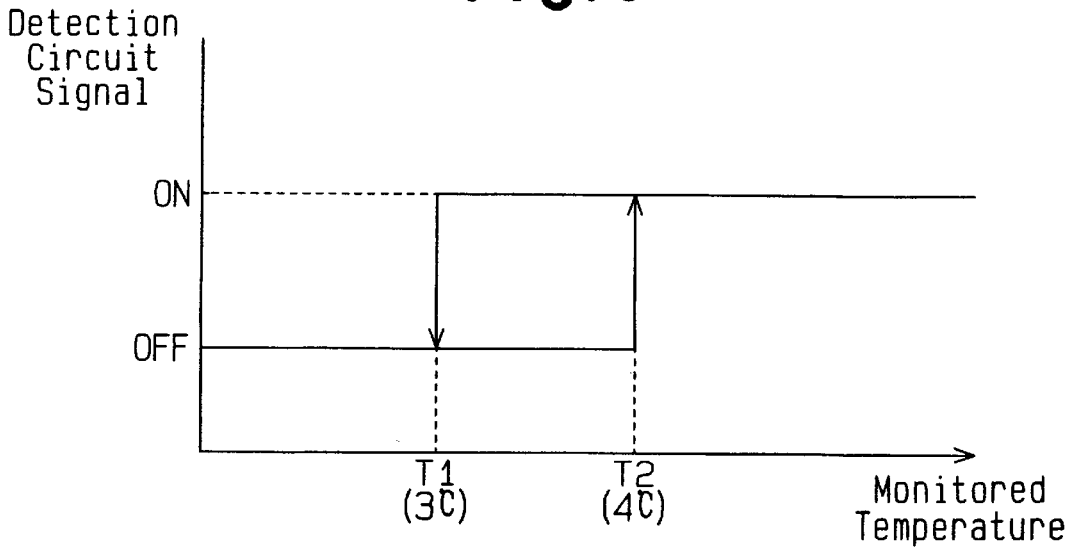
FIG. 6 is a graph showing the correlation between a detection circuit signal and a monitored temperature.

The signal output circuit 87 compares the detected temperature with a predetermined threshold temperature. When the level relationship between those two temperatures is reversed, the signal output circuit 87 sends out a detection circuit signal indicating that event. FIG. 6 shows the correlation between the monitored temperature and the detection circuit signal. Set in the signal output circuit 87 are a lower temperature limit T1 (e.g., 3° C.) and an upper temperature limit T2 (e.g., 4° C.) as threshold values. The signal output circuit 87 outputs an ON signal the instant the monitored temperature rises above the upper temperature limit T2 due to the balance between the amount of the coolant flowing in the evaporator 33 and the temperature of the passenger compartment.

The signal output circuit 87 outputs an OFF signal the instant the monitored temperature shifts below the lower temperature limit T1. That is, the threshold value for switching from the OFF state to the ON state differs from the threshold value for switching from the ON state to the OFF state. The reason for using two different threshold values is to avoid hunting, which is likely to occur when a single threshold value is used, by a so-called hysteresis determination pattern. The threshold temperatures of, for example, 3° C. and 4° C. in this embodiment are adequate temperatures to avoid the frosting of the surface of the evaporator 33 and to produce cool air to cool the passenger compartment of the vehicle.

The controller 70, the external information detector 71, the drive circuit 72 and the control valve CV constitute the control apparatus for the compressor.

Figure 14:
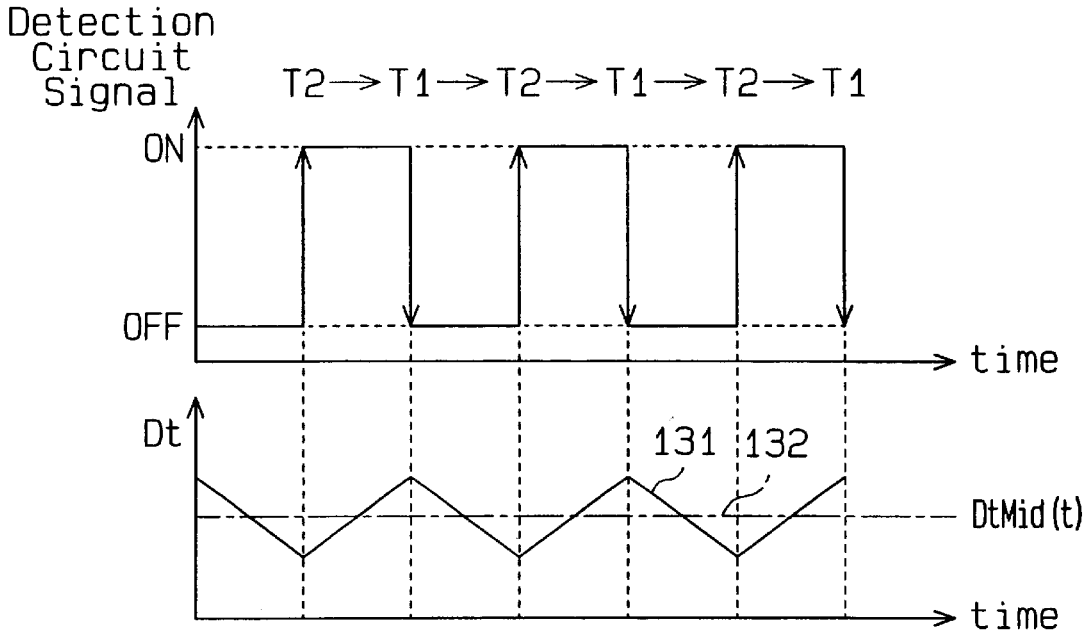
FIG. 14 is a time chart showing the correlation between the duty ratio and the detection circuit signal.

Referring now to the flowcharts in FIGS. 7 to 11 and the time charts of FIGS. 12–14, the duty control of the control valve CV by the controller 70 will be described below. The controller 70 normally performs engine control on the engine E including, for example, control of the supply of fuel. The controller 70 also performs regular and irregular interruption processes associated with air-conditioning.

Figure 7:
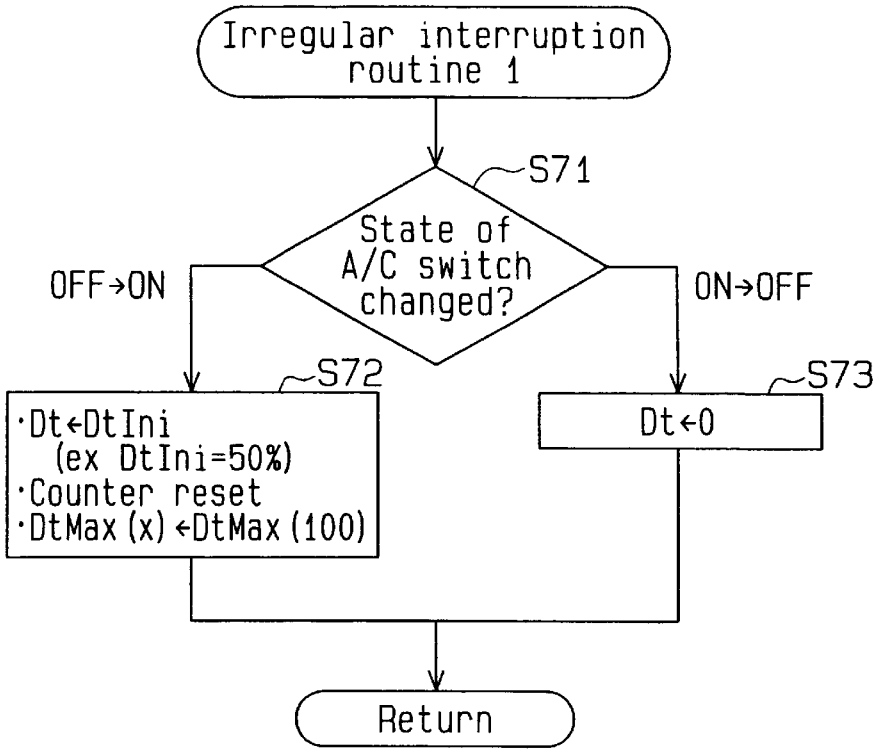
FIG. 7 is a flowchart of an irregular interruption routine (1)

The flowchart in FIG. 7 shows an irregular interruption routine (1) concerning interruption to start and stop the air-conditioning process. When the A/C switch 81 is manipulated and a switch signal is sent to the controller 70, the controller 70 interrupts the engine control and initiates irregular interruption routine 1.

In step S71, the controller 70 determines the ON/OFF state of the A/C switch 81. When the A/C switch 81 is switched ON, the controller 70 performs various kinds of initialization in step S72. For example, the controller 70 sets the duty ratio Dt of the drive signal to be supplied to the control valve CV via the drive circuit 72 to an initial value DtIni (e.g., DtIni=50%), resets the counter and sets the limit value (upper limit value) DtMax(x) of the duty ratio Dt to DtMax(100) (duty ratio of 100%). The initialization causes the degree of opening of the control valve CV to correspond to the initial value DtIni of the duty ratio Dt, which changes Pc to a level that corresponds to the opening size of the control valve CV. As a result, the displacement of the compressor is controlled to a predetermined initial displacement that corresponds to the change in the crank pressure Pc. The setting of the upper limit value DtMax(x) of the duty ratio Dt to DtMax(100) allows the electromagnetic force F or the target pressure difference TPD to be changed within a range up to the maximum value allowed by the structure of the control valve CV.

When the A/C switch 81 is switched OFF, the controller 70 sets the duty ratio Dt to zero in step S73. When the duty ratio Dt is zero, the control valve CV is open to the maximum degree. This increases the crank pressure Pc and swiftly minimizes the inclination angle of the swash plate 12, thereby minimizing the displacement of the compressor. After step S72 or S73, the interruption routine is terminated and the controller 70 restarts engine control.

Figure 8:
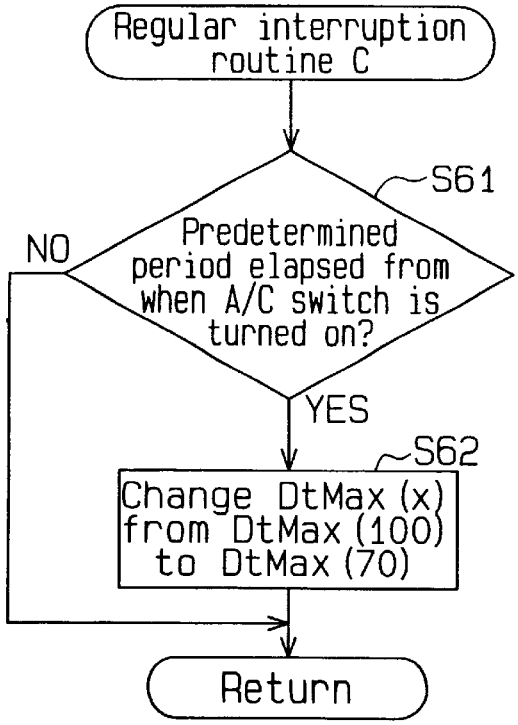
FIG. 8 is a flowchart of a regular interruption routine (C)

The flowchart in FIG. 8 shows regular interruption routine C, which is effective when the A/C switch 81 is ON. The controller 70 interrupts engine control in synchronization with a clock signal from the clock signal generator and executes regular interruption routine C. In step S61, the controller 70 determines whether the counter has counted the pulses of the clock signal up to a predetermined value or not. In other words, the controller 70 determines whether or not a predetermined time (e.g., 5 to 20 minutes) has elapsed since the A/C switch 81 was switched ON.

When the determination is NO in step S61, the controller 70 terminates regular interruption routine C while the upper limit value DtMax(x) kept at DtMax(100) and restarts engine control. When the determination is YES in step S61, the controller 70 changes the upper limit value DtMax(x) of the duty ratio Dt to, for example, 60 to 75% (DtMax(70) (duty ratio of 70%) in this embodiment) from DtMax(100) in step S62. That is, after the predetermined time has elapsed since the switching of the A/C switch 81 to the ON state, the controller 70 changes the upper limit of the duty ratio, which determines the electromagnetic force F and the target pressure difference TPD. After step S62, the interruption routine is terminated and the controller 70 restarts engine control.

Figure 9:
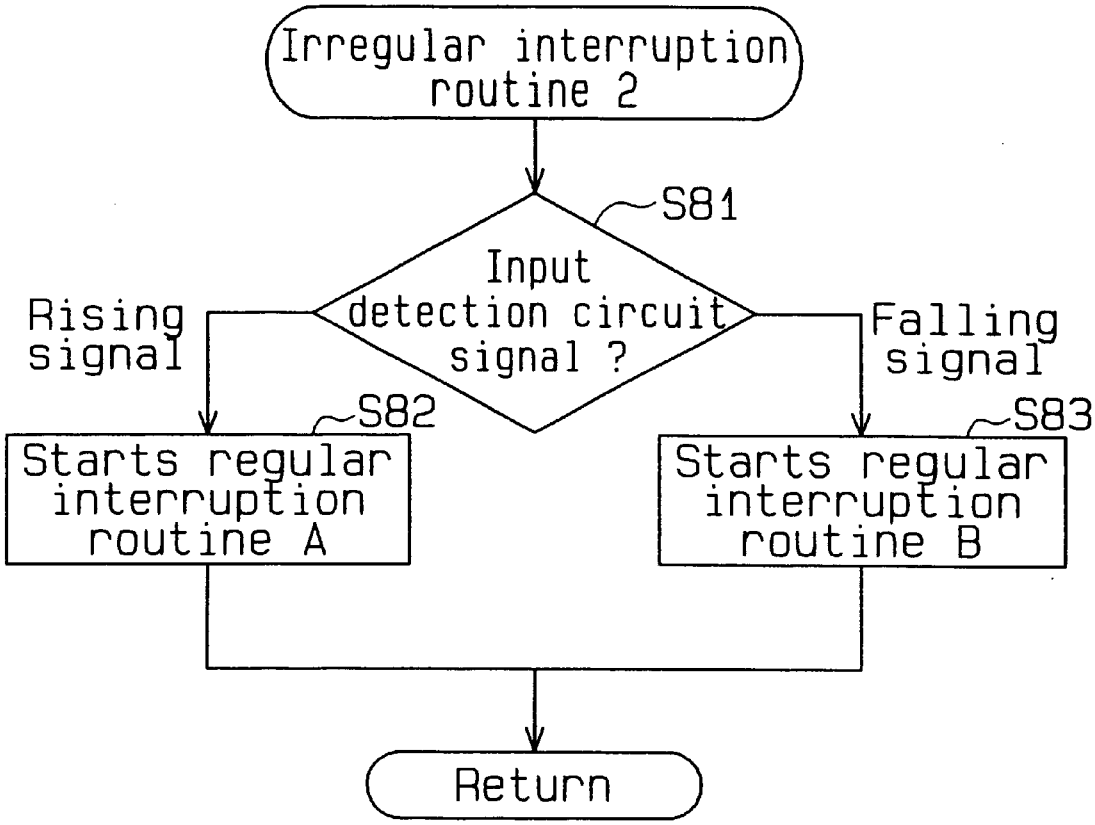
FIG. 9 is a flowchart of an irregular interruption routine (2)
Figure 10:
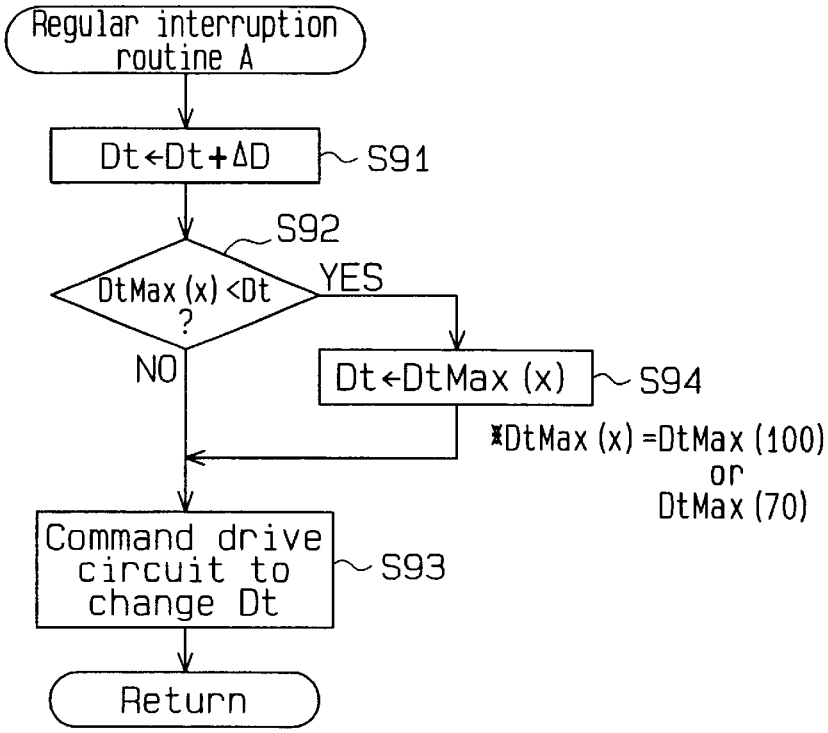
FIG. 10 is a flowchart of a regular interruption routine (A)
Figure 11:
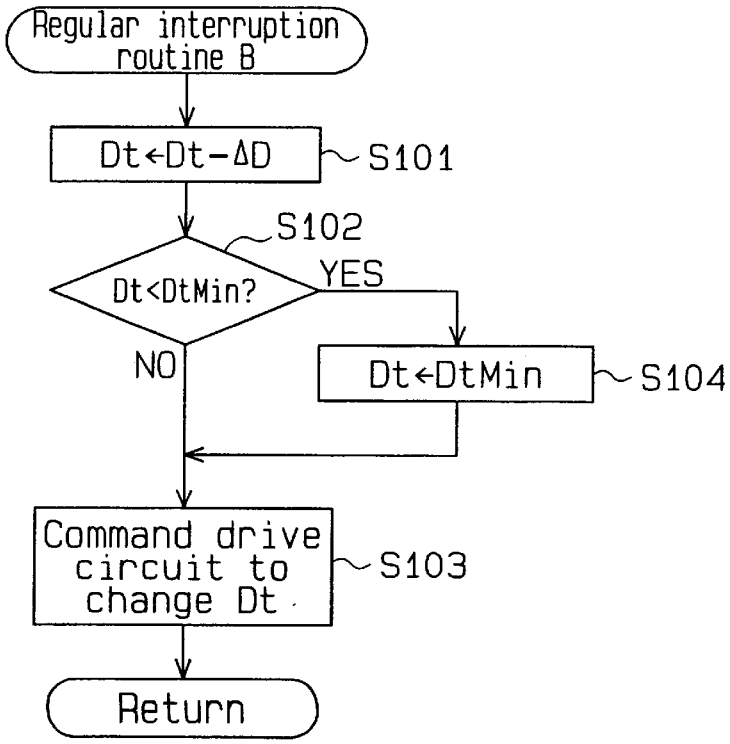
FIG. 11 is a flowchart of a regular interruption routine (B)

The flowchart in FIG. 9 shows irregular interruption routine 2 which is effective when the A/C switch 81 is ON. When the signal output from the detection circuit 85 changes, the controller 70 determines that an interruption request has been made and interrupts engine control to initiate irregular interruption routine 2. When an ON signal is input in step S81, the controller 70 performs a regular interruption routine A, which is shown in FIG. 10, in step S82. When a falling signal is input in S81, the controller 70 performs regular interruption routine B, which is shown in FIG. 11, in step S83. After step S82 or S83, the interruption routine is terminated and the controller 70 restarts engine control.

For example, the instant the temperature near the evaporator 33 drops and the monitored temperature falls below the lower temperature limit T1 due to the discharge of the coolant from the compressor based on the aforementioned initial value DtIni, the controller 70 receives an OFF or falling signal from the detection circuit 85. Then, the controller 70 regularly executes regular interruption routine B, which is shown in FIG. 11, until the routine is changed to routine A upon the next reception of an ON or rising signal. Regular interruption routine B is carried out in synchronism with the clock signal from the clock signal generator.

When the controller 70 interrupts engine control and starts routine B, the controller 70 reduces the present duty ratio Dt by a unit amount ΔD, which is shown in FIG. 11, in step S101. When the duty ratio Dt decreases, the target pressure difference TPD decreases. In other words, the displacement of the compressor is reduced. Consequently, air-conditioning is controlled to reduce cooling.

Subsequently, the controller 70 determines in step S102 whether or not a corrected value Dt−ΔD, or the duty ratio Dt reduced by the unit amount ΔD, is smaller than a preset lower limit value DtMin. When the determination is NO in step S102, the controller 70 commands the drive circuit 72 to change the duty ratio Dt in step S103. Then, the electromagnetic force F of the solenoid section is weakened slightly, which reduces the target pressure difference TPD of the control valve CV accordingly. Then, the actuation rod 40 moves downward, which causes the return spring 66 to expand. The new position of the actuation rod 40 is determined by satisfaction of equation 5. As a result, the degree of opening of the control valve CV, or the degree of opening of the supply passage 28, increases, thus increasing the crank pressure Pc. This increases the difference between the crank pressure Pc and the pressure in a cylinder bore 1*a* via an associated piston 20. As a result, the inclination angle of a swash plate 12 decreases, which reduces the displacement of the compressor. As the displacement of the compressor decreases, the heat removing performance in the evaporator 33 decreases, which reduces the differential pressure between pressure monitor points P1 and P2.

When the determination is YES in step S102, the controller 70 changes the duty ratio Dt to the lower limit value DtMin of, for example, 0% in step S104. Then, the controller 70 instructs the drive circuit 72 to perform duty control with the lower limit value DtMin in step S103.

As regular interruption routine B is repeated, the duty ratio Dt (i.e., the target pressure difference TPD) is reduced decrementally as the time passes. A time chart in FIG. 13 shows a time-dependent change in duty ratio Dt when regular interruption routine B is repeated. The controller 70 reduces the duty ratio Dt by the decremental amount ΔD at a time in accordance with the clock pulse signal until it next receives the ON signal after reception of the OFF signal from the detection circuit 85. Repeating this gradual reduction of the duty ratio Dt by the unit amount ΔD causes the duty ratio Dt to slowly decrease toward the lower limit value DtMin (see the range between t3 and t4 of the graph in FIG. 13). The controller 70 keeps the duty ratio Dt at the lower limit value DtMin until it receives the ON signal from the detection circuit 85 (see the range of the graph in FIG. 13 starting at t4).

When the reduction in the duty ratio Dt reduces the displacement of the compressor and lowers the heat removing performance in the evaporator 33, the temperature in the vehicle or the monitored temperature gradually rises. When the monitored temperature rises above the upper temperature limit T2, the controller 70 receives the ON signal from the detection circuit 85. Then, the controller 70 repeats regular interruption routine A shown in FIG. 10 until it receives the OFF signal.

When the controller 70 interrupts engine control and starts routine A, the controller 70 increases the present duty ratio Dt by the unit amount ΔD in step S91. When the duty ratio Dt increases, the target pressure difference TPD increases. In other words, the displacement of the compressor increases. Consequently, the air-conditioning is controlled to increase the cooling performance.

Subsequently, the controller 70 determines in step S92 whether or not a corrected value Dt+ΔD of the duty ratio Dt is greater than an upper limit value DtMax(x). The upper limit value DtMax(x) is initially set at DtMax(100) in irregular interruption routine 1, as shown in FIG. 7, before a predetermined time has passed since the A/C switch 81 was switched ON. When the predetermined time has passed, on the other hand, the upper limit value DtMax(x) is changed to DtMax(70) in regular interruption routine C, as shown in FIG. 8.

When the upper limit value DtMax(x) is set to DtMax (100) in step S92, the controller 70 merely monitors whether the duty ratio Dt has been computed to be greater than the actual control range (0 to 100%) of the drive signal output from the drive circuit 72. When the controller 70 instructs the drive circuit 72 to set the duty ratio Dt higher than DtMax(100), for example, the target pressure difference TPD is set to DtMax(100). The following is one of the reasons why the controller 70 does not allow the duty ratio Dt to become beyond DtMax(100). Even if regular interruption routine B becomes effective with the duty ratio Dt set above DtMax(100) and the duty ratio Dt is gradually reduced, the target pressure difference TPD is kept at the maximum value until the duty ratio Dt becomes lower than DtMax(100).

The same is true of the case where the duty ratio Dt becomes smaller than DtMin(0%). In step S102, therefore, the controller 70 determines whether or not the duty ratio Dt lies below the actual control range (0–100%) of the drive circuit 72.

When the upper limit value DtMax(x) is set to DtMax(70) in step S92, the controller 70 determines whether or not the target pressure difference TPD calculated in step S91 is equal to or higher than the upper limit value.

When the determination is NO in step S92, the controller 70 commands the drive circuit 72 to change the duty ratio Dt in step S93. Then, the electromagnetic force F of the solenoid section increases, thus increasing the target pressure difference TPD of the control valve CV accordingly. As a result, the actuation rod 40 moves upward, which causes the return spring 66 to be compressed. The actuation rod 40 is shifted such that the downward urging force f2 of the return spring 66 is increased to offset the increase of the upward electromagnetic force F. In other words, the actuation rod 40 shifts to a position where the equation 5 is satisfied. As a result, the degree of opening of the control valve CV, or the degree of opening of the supply passage 28 decreases, thus lowering the crank pressure Pc. This reduces the difference between the crank pressure Pc and the pressure in the cylinder bore 1*a*. Then, the inclination angle of the swash plate 12 increases, which increases the displacement of the compressor. As the displacement of the compressor increases, the heat removing performance in the evaporator 33 is also increased, and the monitored temperature falls. Therefore, the differential pressure between the pressure monitor points P1 and P2 increases.

When the determination is YES in step S92, the controller 70 changes the duty ratio Dt to the upper limit value DtMax(x) in step S94. When the upper limit value DtMax(x) is set to DtMax(100), the controller 70 merely corrects the duty ratio Dt computed in step S91 so that the duty ratio Dt falls within the actual control range (0–100%) of the drive circuit 72 output from the drive circuit 72. Accordingly, the substantial target pressure difference TPD indicated by the duty ratio Dt is maintained. On the other hand, when the upper limit value DtMax(x) is set to DtMax(70), the controller 70 reduces the target pressure difference TPD calculated to be above the upper limit value DtMax(70) in step S91 to the value that matches with the upper limit value DtMax(70). In other words, the target pressure difference TPD is changed to a new TPD that corresponds to the upper limit value DtMax(70). As the flow proceeds to step S93 from step S94, the controller 70 instructs the drive circuit 72 to perform duty control with the upper limit value DtMax(x).

As regular interruption routine A is repeated, the duty ratio Dt and the target pressure difference TPD increase as the time passes.

Figure 12:
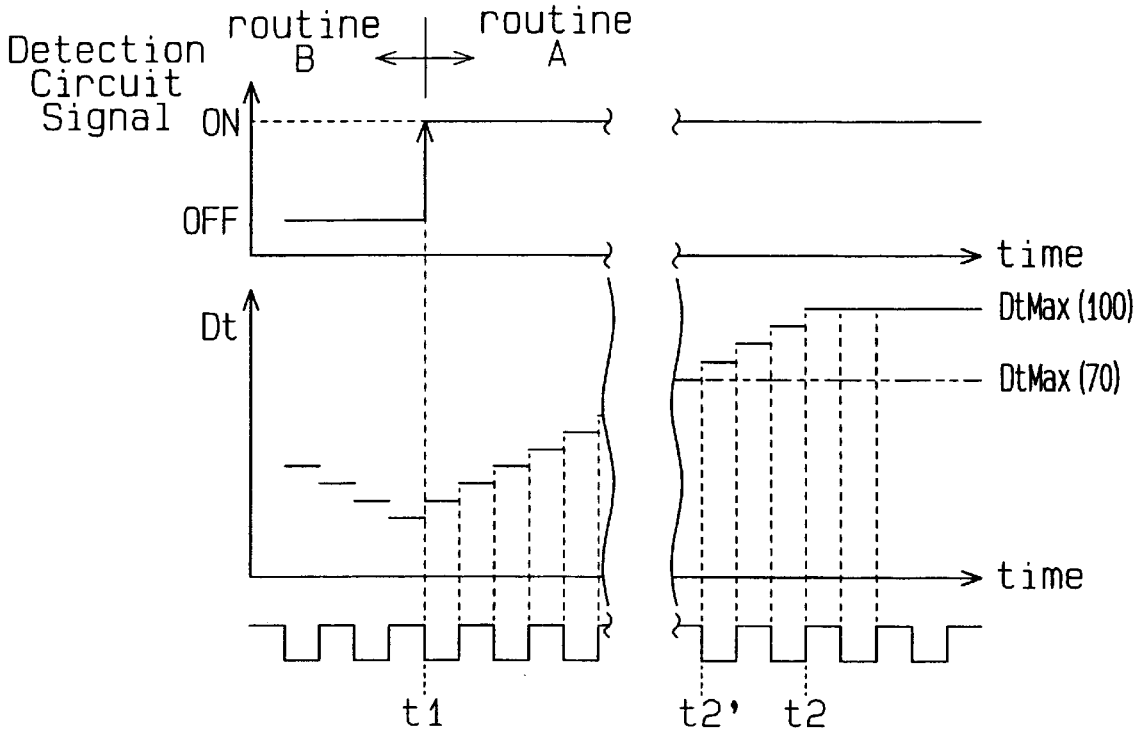
FIG. 12 is a time chart showing the correlation between a duty ratio and a detection circuit signal.

A time chart in FIG. 12 shows a time-dependent change in duty ratio Dt when regular interruption routine A is repeated. The controller 70 increases the duty ratio Dt by the unit amount ΔD incrementally in accordance with the clock pulse signal from the clock signal generator until it receives the OFF signal after reception of the ON signal from the detection circuit 85. Repeatedly increasing the duty ratio Dt by the unit amount D causes the duty ratio Dt to keep increasing slowly with the upper limit value DtMax(x) as the maximum (see the portion between t1 and t2 of the graph in FIG. 12 (when the upper limit value DtMax(x) is DtMax (100)) or t1 to t2' (when the upper limit value DtMax(x) is DtMax(70) indicated by the two-dot chain line)). The controller 70 keeps the duty ratio Dt at the upper limit value DtMax(x) until it receives the OFF signal from the detection circuit 85 (see the portion of the graph in FIG. 12 starting at t2 (when the upper limit value DtMax(x) is DtMax(100)) or starting at t2 (when the upper limit DtMax(x) is DtMax(70) indicated by the two-dot chain line)).

When the increase in the duty ratio Dt increases the displacement of the compressor and increases the heat removing performance in the evaporator 33, the temperature in the vehicle, or the monitored temperature, gradually falls. When the monitored temperature falls below the lower temperature limit T1, the controller 70 repeats regular interruption routine B until it receives the ON signal.

In other words, the controller 70 continues the process of gradually increasing or decreasing the duty ratio Dt, which represents the target pressure difference TPD of the control valve CV. When receiving the detection circuit signal from the detection circuit 85, the controller 70 changes the target pressure difference TPD. Increasing and decreasing the target pressure difference TPD (duty ratio Dt) are alternately repeated in this way. Without a sudden change in cooling load, the duty ratio Dt shows a time-dependent change as indicated by a solid line 131 in a time chart in FIG. 14. When the monitored temperature changes between the threshold temperatures T1 and T2, the rising signal and the falling signal from the detected circuit 85 switches. According to the switching the duty ratio Dt repeats the alternate increase and decrease while nearly keeping a constant fluctuation with respect to the center value, DtMid(t). That is, the ON-OFF control by the controller 70 regulates the duty ratio Dt close to the center value DtMid(t). In this embodiment, DtMid(t) is a variable that varies with the passing of time but is substantially constant as indicated by a one-dot chain line 132 in FIG. 14, for example.

Even if the thermal load of the evaporator 33 varies, the duty ratio Dt, or the target pressure difference TPD, is optimized for controlling the circulation amount of the coolant. This allows the temperature near the evaporator 33 to be kept at the optimal temperature.

This embodiment has the following advantages.

(1) The suction pressure Ps, which is influenced by the level of the thermal load of the evaporator 33, is not directly used as an index for controlling the degree of opening of the displacement control valve CV. The differential pressure ΔP(t) =PdH−PdL between two pressure monitor points P1 and P2 in the cooling circuit is the direct control target in the feedback control of the displacement of the compressor. This enables the displacement to be quickly reduced in the displacement regulation control according to the value of the current supplied independently of the thermal load on the evaporator 33.

(2) The operational efficiency of the compressor decreases lower as the piston speed increases due to an increase in friction. The piston speed is associated with the rotational speed of the drive shaft 6, which has a specific relation with the engine speed NE of the vehicle's engine E, and the displacement of the compressor (which determines the stroke of the piston 20). The compressor cannot change the engine speed NE. To use the compressor efficiently or to improve the operational efficiency of the engine E, therefore, the displacement should not be maximized when the engine speed NE is high. To achieve this, the differential pressure ΔP(t)=PdH−PdL between the two points when the displacement of the compressor is maximum and when the engine speed NE is low should be the maximum value of the target pressure difference TPD used when the duty ratio Dt is DtMax(100). Through this control procedure, when the engine speed NE becomes high, the differential pressure ΔP(t) always exceeds the maximum value of the target pressure difference TPD when the displacement is maximum, and the compressor automatically reduces the displacement from the maximum.

At the initial stage of cooling, an air-conditioning system for a vehicle must produce maximum cooling performance regardless of the engine speed NE. For vehicle air-conditioning systems, therefore, it is desirable to design the control valve in consideration of the initial stage of cooling, rather than high efficiency and light-load operation. That is, the control valve is designed in such a way that the differential pressure ΔP(t)=PdH−PdL between the two points when the displacement of the compressor is maximum and when the engine speed NE is low is the maximum value of the target pressure difference TPD. With such a design, even when the displacement is maximum, no matter how high the engine speed NE is, the differential pressure ΔP(t)=PdH−PdL does not rise above the maximum value of the target pressure difference TPD. When the duty ratio Dt is set to DtMax(100), therefore, the displacement of the compressor is always maximum. This allows the vehicle air-conditioning system to produce the maximum cooling performance at that point, regardless of the engine speed NE, so that the requirement for rapid cooling at the initial stage of cooling is met.

Because of the aforementioned design of the control valve, which prioritizes the control at the initial stage of cooling, if regular interruption routine C in FIG. 8 were not provided, the following problem would occur. Suppose that a predetermined time has elapsed since the switching of the A/C switch 81 to the ON state from the OFF state and the monitored temperature has dropped to a predetermined temperature. In this state, the requirement for rapid cooling at the initial stage of cooling is mostly met and the maximum cooling performance need not be performed thereafter to keep the monitored temperature at the threshold temperature. More specifically, after the requirement for rapid cooling is met, even if the cooling load is heavy, it is possible to provide an adequate amount of coolant without maximizing the displacement of the compressor as long as the engine speed NE is equal to or higher than the vehicle speed V of, for example, 40 km/h at the top gear ratio, i.e., even when the engine speed NE is low. This permits the monitored temperature to be maintained at the threshold temperature without difficulty.

When a control that lacks regular interruption routine C in FIG. 8 is executed, however, use of the duty ratio Dt at the upper limit value DtMax(100) is always permitted. Even after the requirement for rapid cooling at the initial cooling stage is met, therefore, the duty ratio Dt may be set to the upper limit value DtMax(100) at the end of routine A. When the engine speed NE is high, the aforementioned characteristics of the control valve cause the displacement of the compressor to be maximized so that the air-conditioning system maintains the maximum cooling performance. If this state occurs after the requirement for rapid cooling at the initial cooling stage is met, the compressor functions unnecessarily. This results in low efficiency.

According to this embodiment, however, when a predetermined time has elapsed from when the OFF-to-ON switching of the A/C switch 81, the controller 70 determines that the monitored temperature has dropped to a certain level where the requirement for rapid cooling at the initial cooling stage is met, and changes the duty ratio Dt to the upper limit value DtMax(70). After the predetermined time has elapsed since the ON action of the A/C switch 81, the target pressure difference TPD does not rise above the upper limit value determined by the reduced duty ratio. Should the target pressure difference TPD be set to the upper limit value, the differential pressure ΔP(t) between the two monitor points always rises above the upper limit value when the engine speed NE becomes high. Accordingly, the displacement of the compressor automatically falls from the maximum value. Therefore, the compressor does not operate as low efficiency under a high-load unnecessarily, and the operational efficiency of the engine E is improved, which improves fuel consumption. It is also possible to use the compressor over a longer period of time. When the engine speed NE is high or when the engine E is in a high-load state, the displacement of the compressor (load torque) is not maximized. Therefore, the drive load of the engine E is reduced, thus improving acceleration and vehicle performance at high speeds. Since, as a consequence, the amount of heat from the engine E is reduced, the engine cooling system (particularly, the heat exchanger) can be smaller.

(3) The temperature near the evaporator 33 is kept at the optimal temperature for cooling by a simple control procedure to increase and decrease the duty ratio Dt based on the rising signal and falling signal input from the detection circuit 85. That is, the burden of computation on the control unit is reduced by the use of a control sequence that is simple enough to be handled by an interruption routine. This allows the controller 70, which also controls the engine E, to maintain the temperature of the passenger compartment. This eliminates the need for an expensive control unit exclusively for the air-conditioner. This lowers the manufacturing cost of the compressor.

(4) The lower and upper temperature limits T1 and T2 are set as threshold temperatures to provide a hysteresis, which makes the temperature at which the rising signal is output from the detection circuit 85 different from the temperature at which the falling signal is output. This feature avoids hunting, which is apt to result when a single threshold temperature is used, thus stabilizing the displacement control. Hunting in the detection circuit 85 results in frequent generation of the detection circuit signal that indicates the reversing of the level relationship between the monitored temperature and the single threshold temperature.

(5) Since the movable wall 54 and the actuation rod 40 respond to the pressures PdH and PdL at the two pressure monitor points P1 and P2, the force based on the differential pressure ΔP(t)=PdH−PdL is applied to the valve body 43. This embodiment does not therefore require a complicated structure (pressure sensors or the like) that electrically detects the two pressures PdH and PdL at the two pressure monitor points P1 and P2, for example, or a program for electrical control of the coil 67 (drive circuit 72).

(6) The compressor is a variable displacement type swash plate compressor designed to change the stroke of each piston 20 by controlling the crank pressure Pc. The control apparatus of the embodiment is most suitable for displacement control of such a variable displacement type swash plate compressor.

The present invention includes the following embodiments.

Only a single threshold temperature may be set as the threshold temperature instead of setting an upper temperature limit and a lower temperature limit, which are different.

The first pressure monitor point P1 may be located in a suction pressure area between the evaporator 33 and a suction chamber 21, and the second pressure monitor point P2 may be provided at the downstream of the first pressure monitor point P1.

The first pressure monitor point P1 may be located in the discharge pressure area between the discharge chamber 22 and the condenser 31, and the second pressure monitor point P2 may be located in the suction pressure area between the evaporator 33 and the suction chamber 21.

The first pressure monitor point P1 may be located in the discharge pressure area between the discharge chamber 22 and the condenser 31, and the second pressure monitor point P2 may be located in the crank chamber 5. Alternatively, the first pressure monitor point P1 may be in the crank chamber 5, and the second pressure monitor point P2 may be in the suction pressure area between the evaporator 33 and the suction chamber 21. The locations of the first and second pressure monitor points P1 and P2 are not limited to the coolant passage that is the main passage of the cooling circuit and are not limited to the evaporator 33, the suction chamber 21, the cylinder bore 1*a*, the discharge chamber 22 and the condenser 31. That is, the location of each pressure monitor point P1 or P2 is not limited to the high-pressure area or the low-pressure area in the coolant passage. For example, the pressure monitor points P1 and P2 may be provided in the coolant passage for displacement control, which is the sub circuit of the cooling circuit, i.e., the two points P1 and P2 may be in the crank chamber 5 or an intermediate-pressure area among the air intake passage 28, the crank chamber 5 and a bleeder passage 27.

In the latter case, when the displacement of the compressor increases, the differential pressure ΔP(t)=Pc−Ps falls. If the elapsed time is equal to or greater than a predetermined time, therefore, the differential pressure ΔP(t) between the two pressure monitor points is set to the lower limit. Then, the target-differential-pressure determiner compares the target pressure difference computed by the target-differential-pressure calculator with the lower limit, and determines the target pressure difference as a new target pressure difference when the target pressure difference is equal to or higher than the lower limit or determines the lower limit as a new target pressure difference when the target pressure difference is lower than the lower limit.

The control valve may be electrically driven, and the pressures PdH and PdL at the two pressure monitor points P1 and P2 may be detected by associated pressure sensors.

The control valve may be a so-called outlet control valve, which regulates the crank pressure Pc by adjusting the degree of opening of the bleed passage 27.

The control valve may be a three-way valve that regulates the crank pressure Pc by adjusting the opening size of both the air intake passage 28 and the bleed passage 27.

The power transmission mechanism PT may be equipped with a clutch mechanism such as an electromagnetic clutch.

The present invention may be embodied into a control apparatus for a wobble type variable displacement type compressor.

It should be apparent to those skilled in the art that the present invention may be embodied in many other specific forms without departing from the spirit or scope of the invention. Particularly, it should be understood that the invention may be embodied in the following forms.

Therefore, the present examples and embodiments are to be considered as illustrative and not restrictive and the invention is not to be limited to the details given herein, but may be modified within the scope and equivalence of the appended claims.

What is claimed is:

1. A controller for controlling the displacement of a compressor, which is included in a refrigeration circuit of an air conditioning system, the controller comprising:

a pressure difference detector for detecting the pressure difference between two pressure monitoring points located in the refrigeration circuit;

an air conditioning switch for turning the air conditioning system on;

a temperature detector for detecting the temperature in a compartment;

a mechanism for controlling the displacement of the compressor such that the pressure difference detected by the pressure difference detector approaches a target value; and a computer for determining the target value, wherein the computer changes the target value, depending on the detected temperature, and limits the target value to a target value limit, and after a predetermined time expires from when the air conditioning switch is turned on, the computer changes the limit.

2. The controller according to claim 1, wherein the temperature detector has a temperature sensor and a signal output circuit, wherein the signal output circuit sends a rising signal, which indicates that the temperature of the compartment is increasing, and a falling signal, which indicates that the compartment temperature is falling, to the computer, and the computer increases the target value when one of the rising or falling signal is received and decreases the target value when the other of the rising or falling signal is received.

3. The controller according to claim 1, wherein the temperature detector has a temperature sensor and a signal output circuit, wherein the signal output circuit sends a rising signal, which indicates that the temperature of the compartment has increased above a first level, and a falling signal, which indicates that the compartment temperature has fallen below a second level, to the computer, and the computer increases the target value when one of the rising or falling signal is received and decreases the target value when the other of the rising or falling signal is received.

4. The controller according to claim 1, wherein the refrigerant circuit includes an evaporator, wherein the temperature detector is located near the evaporator.

5. The controller according to claim 1, wherein the compressor includes a drive plate and a crank chamber for accommodating the drive plate, wherein the inclination angle of the drive plate changes in accordance with the pressure in the crank chamber to vary the displacement of the compressor, and wherein the mechanism for controlling the displacement comprises:

a control valve, the opening size of which is changed in accordance with an external command to adjust the pressure in the crank chamber, wherein the control valve includes the pressure difference detector, and the control valve changes the opening size of the control valve based on the detected pressure difference.

6. The controller according to claim 5, wherein the control valve comprises:

a valve body, the position of which is changed by a force produced by the pressure difference detector; and an actuator, wherein the actuator applies a force based on the target value to the valve body according to the external command.

7. The controller according to claim 1, wherein the refrigerant circuit includes an evaporator, the compressor has a discharge pressure zone, and the pressure monitoring points are located in the refrigerant circuit between the evaporator and the discharge pressure zone.

8. A method for controlling the displacement of a compressor installed in a refrigerant circuit of an air-conditioning system, the method including:

detecting the pressure difference between two pressure monitoring points located in the refrigerant circuit by a pressure difference detector;

detecting the temperature in a compartment;

determining a target value of the pressure difference, wherein the determining includes limiting the target value to a target value limit;

changing the target value depending on the detected temperature;

changing the target value limit after a predetermined time expires from when the air conditioning system is activated; and controlling the displacement of the compressor such that the pressure difference detected by the pressure difference detector approaches the target value.

* * * * *